US006652664B2

(12) United States Patent
Durocher et al.

(10) Patent No.: US 6,652,664 B2
(45) Date of Patent: Nov. 25, 2003

(54) OIL PUMP SCREEN CLEANING METHOD AND APPARATUS

(76) Inventors: Leo R. Durocher, 111 N. James Ave., Orlando, FL (US) 32801; Joseph T. Hesseling, 3715 Edland Dr., Orlando, FL (US) 32812

( * ) Notice: Subject to any disclaimer, the term of this patent is extended or adjusted under 35 U.S.C. 154(b) by 102 days.

(21) Appl. No.: 10/042,928

(22) Filed: Jan. 9, 2002

(65) Prior Publication Data

US 2003/0127112 A1 Jul. 10, 2003

(51) Int. Cl.[7] ..... B08B 3/08

(52) U.S. Cl. ..... 134/26; 134/22.17; 134/22.18; 134/22.19

(58) Field of Search ..... 141/65, 85; 184/1.5; 134/22.1, 22.17, 22.18, 22.19, 26, 27, 29, 40; 123/196 R, 196 A

(56) References Cited

U.S. PATENT DOCUMENTS

| | | | | | |
|---|---|---|---|---|---|
| 2,525,978 | A | | 10/1950 | Vallerie | |
| 2,667,852 | A | * | 2/1954 | Brown, Jr. | 228/5.1 |
| 2,729,266 | A | * | 1/1956 | Humphrey | 72/299 |
| 3,368,377 | A | * | 2/1968 | Hirayama et al. | 72/128 |
| 3,902,344 | A | * | 9/1975 | Stuart | 72/128 |
| 4,059,004 | A | * | 11/1977 | Perkins | 72/299 |
| 4,188,813 | A | * | 2/1980 | Bournicon et al. | 72/299 |
| 4,437,329 | A | * | 3/1984 | Geppelt et al. | 72/299 |
| 4,451,266 | A | | 5/1984 | Barclay et al. | |
| 4,459,164 | A | * | 7/1984 | Yoshioka et al. | 148/508 |
| 5,074,380 | A | * | 12/1991 | Bedi et al. | 184/1.5 |
| 5,154,775 | A | * | 10/1992 | Bedi | 134/22.1 |
| 5,190,120 | A | | 3/1993 | Watts | |
| 5,232,513 | A | | 8/1993 | Suratte et al. | |
| 5,460,656 | A | * | 10/1995 | Waelput et al. | 134/10 |
| 5,467,746 | A | | 11/1995 | Waelput et al. | |
| 5,566,781 | A | | 10/1996 | Robert et al. | |
| 5,665,171 | A | | 9/1997 | Leaphart | |
| 6,089,205 | A | | 7/2000 | Grigorian et al. | |
| 6,142,161 | A | | 11/2000 | Abbruzze | |
| 6,263,889 | B1 | | 7/2001 | Flynn et al. | |

* cited by examiner

*Primary Examiner*—Randy Gulakowski
*Assistant Examiner*—Saeed Chaudhry
(74) *Attorney, Agent, or Firm*—Edward M. Livingston, Esq.

(57) ABSTRACT

An oil-pump-screen (1) cleaning method and apparatus with which an oil pan (3) of an internal-combustion engine (2) is drained by removal of a drain plug (7) from a drain aperture (15); the drain plug is reinserted in the drain aperture; a measured amount of a predetermined carbon-disintegrative liquid is put in the oil pan, preferably through a dipstick tube (10), to immerse the oil-pump pickup screen, but not the oil pump (41) without contacting engine bearings, gaskets, or other engine components that could be deteriorated or otherwise damaged by the carbon-disintegrative liquid. The cleaner liquid is left in the oil pan long enough, preferably about one hour, for it to disintegrate and dislodge all carbonic and other material from the oil-pump pickup screen while not running the engine or otherwise conveying the carbon-disintegrative liquid to other parts of the engine. The oil pan is drained to remove the cleaner liquid, the drain plug is replaced and flush liquid is put into the oil pan where it is left for about forty-five minutes. The oil pan is then drained and filled with new engine oil or other liquid lubricant. A clean-run oil filter (5), which can be the old oil filter, is left in or put into the oil-filter cannister (6) while the engine is run for about two-to-ten minutes. Then, the oil filter is replaced with a new one and the oil level is adjusted to complete the method.

29 Claims, 5 Drawing Sheets

FIG. 1
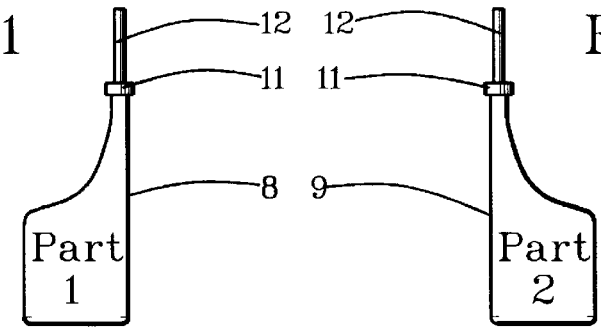
FIG. 2
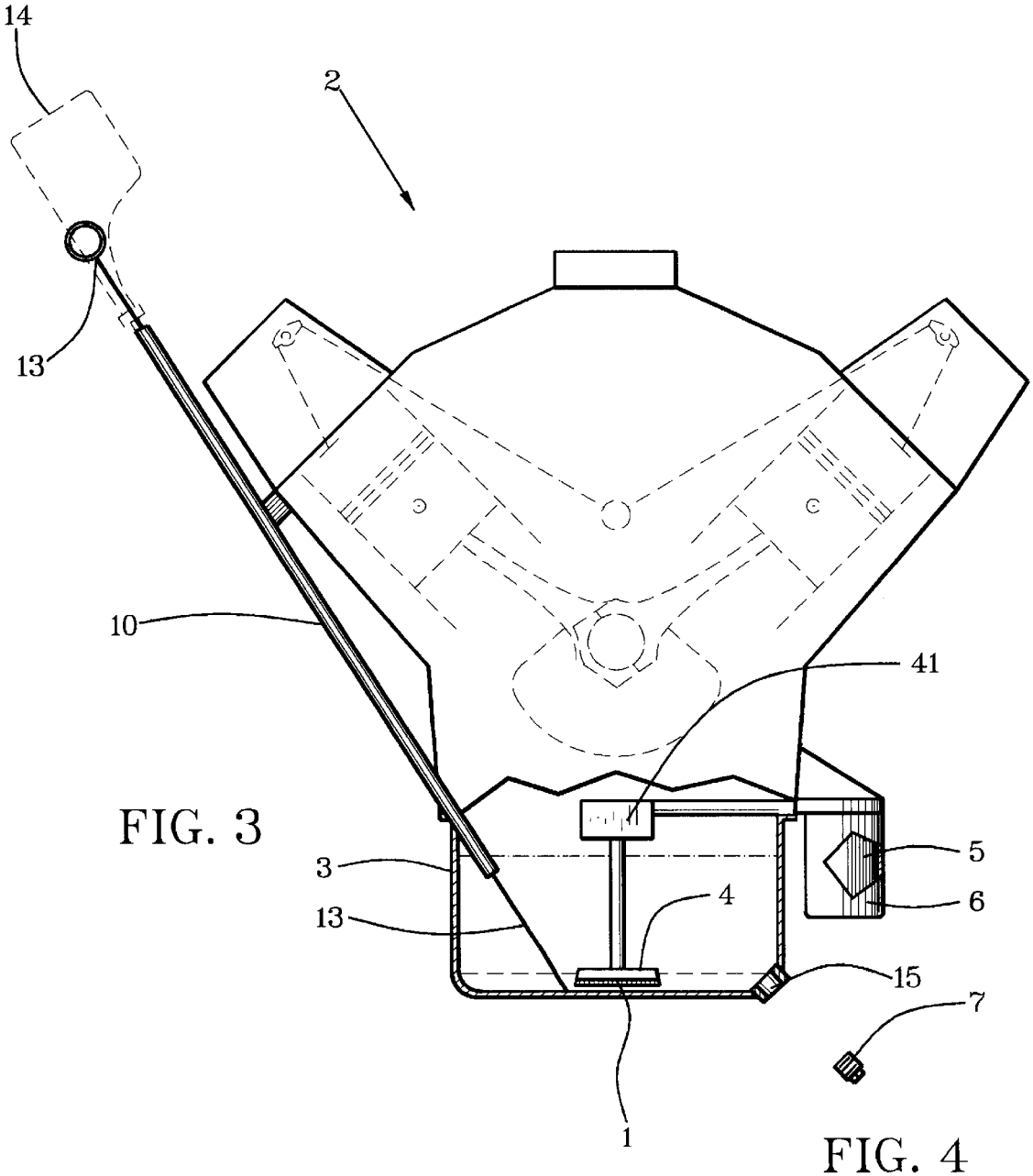
FIG. 3
FIG. 4

OIL PUMP SCREEN CLEANING METHOD AND APPARATUS

BACKGROUND OF THE INVENTION

This invention relates to internal cleaners of oil-pump screens in internal-combustion engines.

A major problem with long use of internal-combustion engines is carbonization-clogging of oil-pump screens. Carbonic and other combustion residues of engine oil and fuel accumulate solidly on oil-pump screens. There they obstruct flow of oil to oil pumps from the oil-pump screens, resulting in inadequate lubricating and cooling of bearings, valve guides, cams and other moving parts of engines. This situation is mis-diagnosed most often as failure of oil pumps because it decreases oil pressure that is readable on an oil-pressure gauge such a mis-diagnosis requires the oil pump to be repaired or replaced rather than the oil-pump screen which is the real problem. Repair or replacement of oil pumps or oil screen is expensive because it requires expensive removal of the engine for nearly all present automotive construction.

There are known cleaners and methods for cleaning oil-pump screens, but not with the completeness, low cost and engine protection made possible by this invention. Some prior devices, cleaning substances and methods employ engine and fuel-pump circulation of cleaning solvents that would destroy engine seals, bearings and other engine components if the cleaner were a strong enough solvent to be sufficiently effective. Others employ expensive bypass of the oil system instead of cleaning it.

Examples of most-closely related known but different devices are described in the following patent documents:

| Patent No. (U.S. unless stated otherwise) | Inventor | Issue Date |
|---|---|---|
| 3,902,344 | Stuart | 09-02-1975 |
| 2,667,852 | Brown, Jr. | 02-02-1954 |
| 3,368,377 | Hirayama, et al. | 02-13-1968 |
| 4,059,004 | Perkins | 11-22-1977 |
| 2,729,266 | Humphrey | 01-03-1956 |
| 4,459,164 | Yoshioka, et al. | 07-10-1984 |
| 4,188,813 | Bournicon, et al. | 02-19-1980 |
| 4,437,329 | Geppelt, et al. | 03-20-1984 |

SUMMARY OF THE INVENTION

Objects of patentable novelty and utility taught by this invention are to provide an engine-oil-pump-screening apparatus and method which:

- removes solid buildup of carbonic and other residues of combustion from engine-oil-pump screens internally without removal of oil pans from internal-combustion engines;
- does not damage or destroy engine bearings, seals or other components; and
- does not dislodge solid particles and convey them to the oil pump from other parts of the engine to the oil pump and to the oil-pump pickup screen.

This invention accomplishes these objectives with an oil-pump-screen cleaning apparatus and method with which: (a) an oil pan of an engine is drained by removal of a drain plug from a drain aperture; (b) the drain plug is reinserted in the drain aperture; (c) a measured amount of a predetermined carbon-disintegrative liquid is put in the oil pan, preferably through a dipstick tube, to immerse the oil-pump pickup screen, but not the oil pump without contacting engine bearings, gaskets, or other engine components that could be deteriorated or otherwise damaged by the carbon-disintegrative liquid; (d) the carbon-disintegrative liquid is left in the oil pan long enough, preferably about one hour, for the carbon-disintegrative liquid to disintegrate and dislodge all carbonic and other material from the oil-pump pickup screen while not running the engine or otherwise conveying the carbon-disintegrative liquid to other parts of the engine; (e) the carbon-disintegrative liquid containing disintegrated carbonic and other materials is removed from the oil pan by removal of the drain-plug which is then reinserted into the drain-plug aperture; (f) an amount of flush liquid, preferably kerosene, comparable to the amount of the carbon-disintegrative liquid is put in the oil pan through preferably the dipstick tube and allowed to soak about forty-five minutes; (g) the flush liquid is removed and the drain plug reinserted; (h) the oil pan is filled with new engine oil or liquid synthetic lubricant that can be silicon-based; (i) a clean-run oil filter, which can be one used previously in the engine, is left in or placed in a filter container temporarily; (j) the engine is then clean-run at various speeds for two-to-ten minutes to convey any disintegrated material to the clean-run oil filter; (k) the clean-run oil filter is replaced with a new oil filter; and (l) oil level of the engine is checked for proper fill level to complete the process.

The apparatus for using this method is preferably a pair of two fluid dispensers. One is a cleaner dispenser for putting a proper amount of the carbon-disintegrative liquid into the oil pan through the dipstick tube or through the drain aperture. The other is a flush dispenser that is sized for putting approximately the same amount of flush liquid into the oil pan in the same manner as for the carbon-disintegrative liquid. Both are labeled accordingly and provided with instruction for their respective uses. Both also have outlets for insertion of fluid through the dipstick tube so as to avoid contact with parts of the engine.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 1 is a side elevation view of a Part 1 cleaner container for containment and for dipstick-tube conveyance of a carbon-disintegrative liquid having a capacity to disintegrate and to dislodge hardened buildup of carbonic and other combustion-related engine-oil and fuel material from a pickup screen of an oil pump of an internal combustion engine;

FIG. 2 is a side elevation view of a Part 2 flush container for containment and for dipstick-tube conveyance of a flush liquid having a capacity to dislodge and to convey disintegrated buildup of the carbonic and other combustion-related engine-oil and fuel material from the oil-pump pickup screen for being conveyed and drained from the oil pan of the internal combustion engine;

FIG. 3 is a partially cutaway plan front view of the internal-combustion engine showing relationship of a dashed-line representation of a Part 1 or a Part 2 container to a dipstick tube in fluid communication to the oil-pump pickup screen without contact of cleaner liquid or flush liquid with cleaner-vulnerable parts of the internal-combustion engine;

FIG. 4 is a side view of a drain plug for draining fluids from an oil pan of the internal-combustion engine;

DESCRIPTION OF PREFERRED EMBODIMENT

Figure 5:
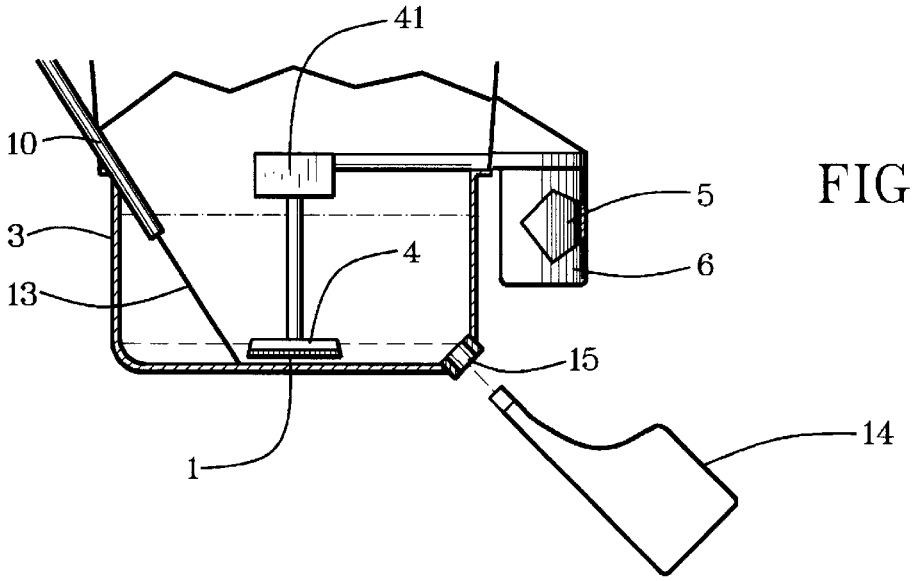
FIG. 5 is a fragmentary and partially cutaway front view of the oil pan in relationship to a cleaner container or a flush container that is fluid communicative with the oil pan through a drain aperture.

Listed numerically below with reference. to the drawings are terms used to describe features of this invention. These terms and numbers assigned to them designate the same features throughout this description.

| | |
|---|---|
| 1. | Oil-pump pickup screen |
| 2. | Internal-combustion engine |
| 3. | Oil pan |
| 4. | Oil-pump pickup assembly |
| 5. | Oil filter |
| 6. | Oil-filter cannister |
| 7. | Drain plug |
| 8. | Cleaner container |
| 9. | Flush container |
| 10. | Dipstick tube |
| 11. | Container cap |
| 12. | Tubular extension |
| 13. | Dipstick |
| 14. | Liquid containers |
| 15. | Drain aperture |
| 16. | Container tube |
| 17. | Cleaner aperture |
| 18. | Provide liquids |
| 19. | Drain oil |
| 20. | Add cleaner |
| 21. | Soak in cleaner liquid |
| 22. | Drain cleaner liquid |
| 23. | Add flush liquid |
| 24. | Drain flush liquid |
| 25. | Add new oil |

-continued

| | |
|---|---|
| 26. | Run engine |
| 27. | Provide Part 1 cleaner |
| 28. | Remove dipstick |
| 29. | Add cleaner thru dipstick tube |
| 30. | Soak in oil pan |
| 31. | Drain oil pan |
| 32. | Start Part 2 |
| 33. | Provide Part 2 Flush in container |
| 34. | Add flush thru dipstick tube |
| 35. | Soak in oil pan |
| 36. | Drain oil pan |
| 37. | Fill oil pan with new oil |
| 38. | Clean-run engine |
| 39. | Replace oil filter |
| 40. | Adjust oil level |
| 41. | Oil pump |

Referring to FIGS. 1–4 and 10–11, a method for in-place cleaning of an oil-pump pickup screen 1, shown in FIGS. 3, and 5–7, in an internal-combustion engine 2, shown in FIG. 3, includes first, draining engine oil or other liquid lubricant from an oil pan 3 of the internal-combustion engine 2. Then, an amount of a predeterminedly cleaning liquid for immersing the oil-pump pickup screen 1 is put into the oil pan 3 while preventing escape of the cleaning liquid and while preventing contact of the cleaning liquid with internal portions, parts and components of the internal-combustion engine 2, except for the oil-pump pickup screen 1 and portions of an inside periphery of the oil pan 3 and an oil-pump pickup assembly 4, shown in FIGS. 3 and 5–7, which contain the cleaning liquid in contact with the oil-pump pickup screen 1.

The internal portions, parts and components of the internal-combustion engine 2 which could be damaged with a cleaner liquid having sufficient solvency capacity for the in-place cleaning include bearings and gaskets. It is also important that a oil pump 41 not be contacted by the cleaner liquid.

The cleaning liquid is allowed to remain in contact with the oil-pump pickup screen 1 for a sufficient time for the cleaning liquid to disintegrate and to dislodge hardened buildup of carbonic and other combustion-related engine-oil and fuel material from the oil-pump pickup screen 1. The cleaning liquid and any dislodged carbonic and other combustion-related engine-oil and fuel material are then drained from the oil pan 3.

An amount of a predetermined flush fluid to immerse the oil-pump pickup screen 1 is then put into the oil pan 3 and allowed to remain in contact with the oil-pump pickup screen 1 for a sufficient time for the flush liquid to mix with any disintegrated and dislodged buildup of hardened carbonic and other combustion-related engine-oil and fuel material for fluid conveyance thereof from the oil-pump pickup screen 1 from the inside of the oil pan 3.

An oil filter 5, which can be a pre-used oil filter 5, for clean-running the internal-combustion engine 2 is left in or put in an oil-filter cannister 6. The flush liquid is then drained from the oil pan 3. After replacing a drain plug 7 in the oil pan 3, new oil is put into the oil pan 3. The internal-combustion engine is run for two-to-ten minutes at varying speeds to circulate any disintegrated and dislodged material into the oil filter, which for clean-running is referred to as a clean-run oil filter 5. The clean-run oil filter 5 is then replaced with a new oil filter 5. Level of the new oil is then adjusted as specified for the internal-combustion engine 2.

This completes the method. Reliability, convenience and time-saving options are provided as follows.

The cleaning liquid can include a solvent capacity that is strong enough to damage bearings and gaskets of the internal-combustion engine 2 in addition to including a carbon-disintegrative capacity to disintegrate and to dislodge the hardened buildup of carbonic and other combustion-related engine-oil and fuel material from the oil-pump pickup screen 1. The flush liquid can include a flushing capacity to flush any disintegrated and dislodged carbonic and other combustion-related engine-oil and fuel material in addition to being miscible with engine oil or other liquid engine lubricant.

The cleaning liquid preferably is selected from a class of isomeric aromatic hydrocarbons $C_8H_{10}$ that are di-methyl homologues of benzine. Included can be high-power solvents xylene and toluene. The flush liquid is selected from a class of solvents that includes kerosene.

Preferably, as shown in FIGS. 1–2 and 8–9, the cleaning liquid is provided in a forty-eight-ounce cleaner container 8 and the flush liquid is provided in a forty-eight-ounce flush container 9. The cleaner container 8 is identified as being a Part 1, Cleaner. The flush container 9 is identified as being a Part 2, Flush.

Preventing contact of the cleaning liquid with the internal portions, parts and components of the internal-combustion engine 2 while the cleaning liquid is being put into the oil pan 3 to immerse and to soak the oil-pump pickup screen 1 is critical, due to high potency of the cleaning fluid. It is also critical to prevent contact of the flush liquid with the internal portions, parts and components of the internal-combustion engine 2 while the flush liquid is being put into the oil pan 3. On nearly all internal-combustion engines, there is a dipstick tube 10 that bypasses these portions, parts and components of internal combustion engines 2. For this reason, preferred cleaner containers 8 and flush containers 9 include a container cap 11 having a tubular extension 12 which is a fluid conveyance that can be inserted in the dipstick tube 10 when a dipstick 13 has been removed from the dipstick tube 10 for putting the cleaner liquid and the flush liquid in the oil pan 3.

Figure 6:
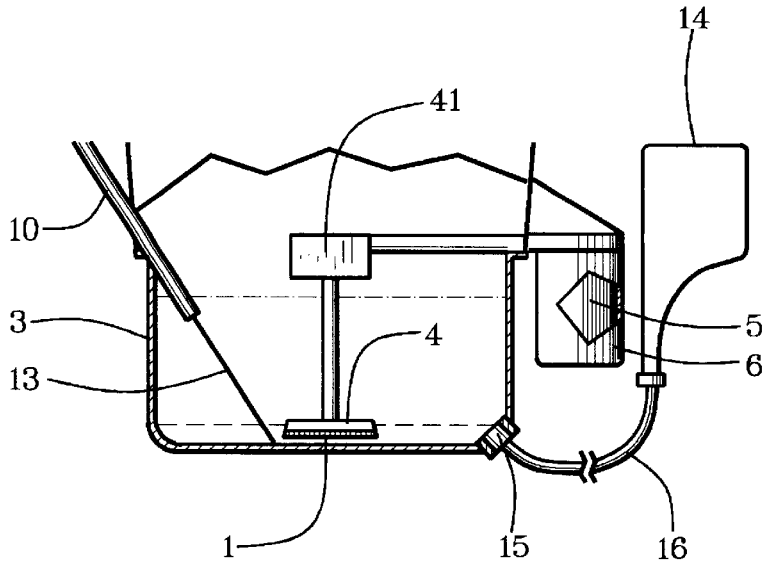
FIG. 6 is a fragmentary and partially cutaway front view of the oil pan in relationship to the cleaner container or the flush container that is fluid communicative with the oil pan through a tube to the drain aperture.
Figure 7:
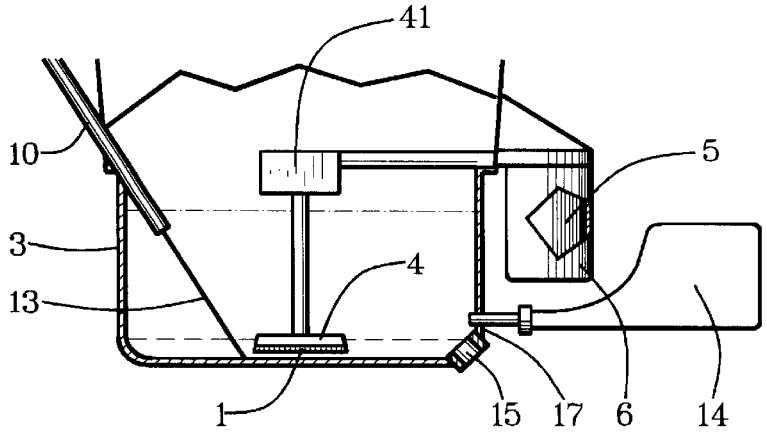
FIG. 7 is a fragmentary and partially cutaway front view of the oil pan in relationship to a cleaner container or a flush container that is fluid communicative with the oil pan through any other access that is not communicative with cleaner-vulnerable parts and components of the internal-combustion engine.
Figure 8:
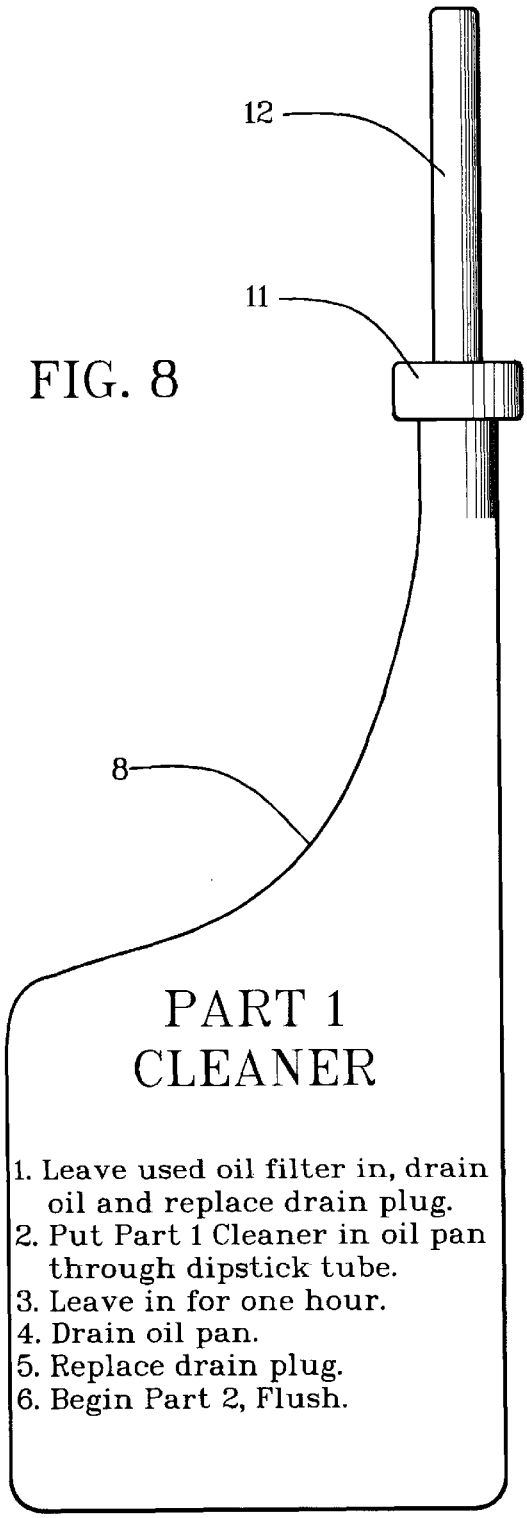
FIG. 8 is a side elevation view of a cleaner container having instructions for its use to put cleaner liquid into the internal-combustion engine through a dipstick tube with the dipstick removed.
Figure 9:
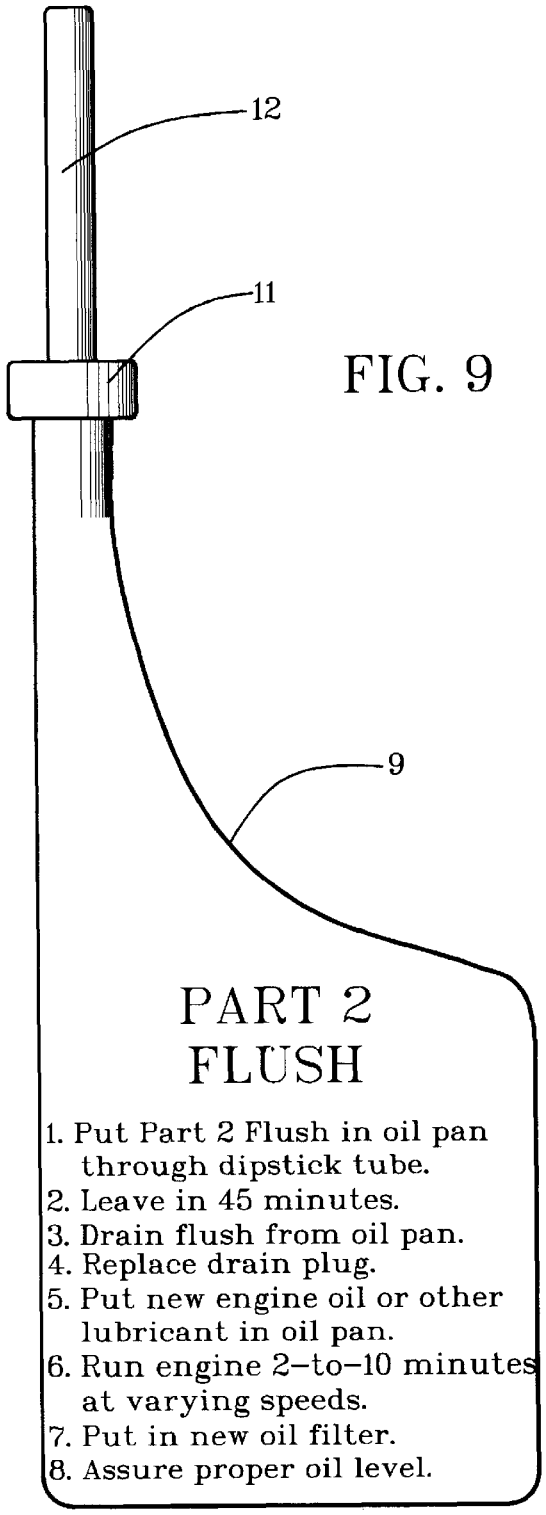
FIG. 9 is a side elevation view of a flush container having instructions for its use to put flush liquid into the internal-combustion engine through the dipstick tube with the dipstick removed.

On some internal-combustion engines 2, however, the dipstick tube 13 is difficult to access for conveyance of the cleaner liquid or the flush liquid. For them, liquid containers 14, can be attachable directly to a drain aperture 15 as shown in FIG. 5. For others, a container tube 16 can be provided for access to either the drain aperture 15 as shown in FIG. 6 or to the dipstick tube 10. For yet other internal-combustion engines 2, a separate cleaner aperture 17 can be provided as shown in FIG. 7.

It is preferable that the cleaner container 8 and the flush container 9 or the liquid container 14 of either liquid be collapsible for squeezing the contents into whichever conveyance to the oil pan 3 is available for particular internal-combustion engines 2 . Optionally to being collapsible is a vacuum-relief line in communication to an opposite end of the containers 8, 9 or 14 from proximate the container cap 11.

Preferably, the cleaner container 8 includes legible identity as a container of the cleaning liquid. Correspondingly, the flush container 9 includes legible identity as a container of the flush liquid. Preferably also, the cleaner container 8 includes cleaner directions for use of the carbon-disintegrative liquid for in-place cleaning while preventing its contact with parts and components of the internal-combustion engine 2 that such contact would damage. Similarly, the flush container 9 preferably includes flush directions for use of the flush fluid for in-place flushing while preventing contact of the flush liquid with internal portions, parts and components of the internal-combustion engine 2.

Preferably, the cleaner directions include instructions to: (a) insert the carbon-disintegrative liquid through the dipstick tube 10 after draining the oil from the oil pan 3 and replacing the drain plug 7 in the drain aperture 15; (b) leave the carbon-disintegrative liquid in the oil pan 3 for one hour; (c) drain the carbon-disintegrative liquid from the oil pan 3; (d) replace the drain plug 7 in the drain aperture 15; and then to (e) flush the oil pan 3 as directed on the flush container 9.

Preferably, the flush directions include instructions to: (a) insert the flush liquid through the dipstick tube 10 after draining the carbon-disintegrative liquid from the oil pan 3 and replacing the drain plug 7 in the drain aperture 15; (b) leave the flush liquid in the oil pan 3 for about forty-five minutes; (c) drain the flush liquid from the oil pan 3; (d) replace the drain plug 7 in the drain aperture 15; (e) fill the oil pan 3 with new engine oil or other liquid lubricant; (f) run the internal-combustion engine 2 for about two-to-ten minutes at varying speeds while a clean-run oil filter 5, which can be a used oil filter 5, is in the oil-filter cannister 6; (g) replace the clean-run oil filter 5 with a new oil filter 5; and then (h) assure that a proper amount of engine oil or other liquid lubricant is in the oil pan 3 for running the internal-combustion engine 2 selectively thereafter.

Figure 10:
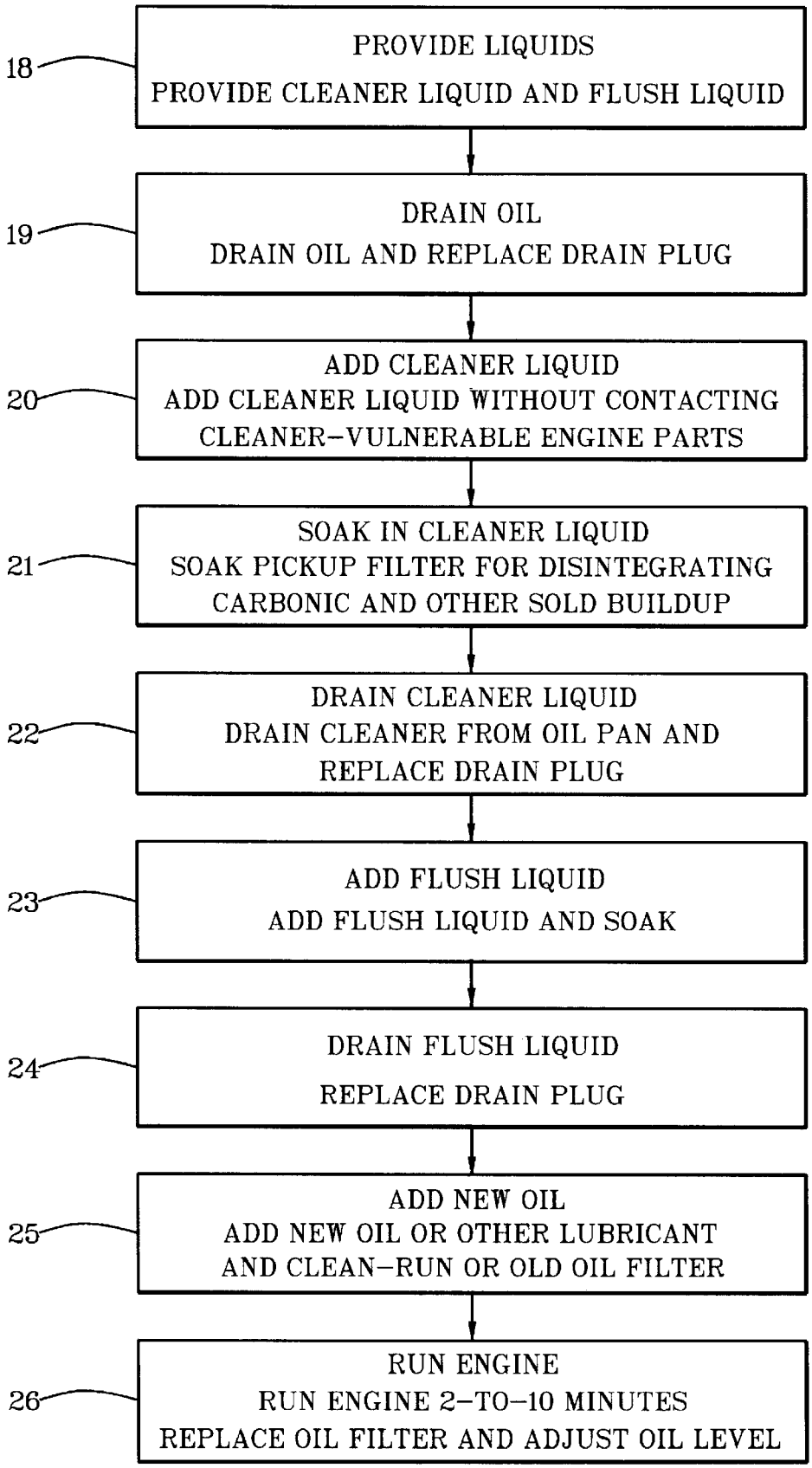
FIG. 10 is a diagram of a method for using this invention independently of putting the cleaner liquid and the flush liquid in through the dipstick tube.

Referring to FIG. 10, steps included for this method without a specific cleaner container 8 and flush container 9 are to: 18 provide liquids, cleaner liquid and flush liquid; 19, drain oil and replace the drain plug 7 in the drain aperture 15; 20, add cleaner liquid without contacting cleaner-vulnerable engine components; 21, soak in cleaner liquid for disintegrating and dislodging carbonic and other solid buildup on the oil-pump pickup screen 1; 22, drain cleaner liquid and replace drain plug 7; 23, add flush liquid and soak for mixing any disintegrated and dislodged carbonic and other materials with the flush liquid; 24, drain flush liquid and replace the drain plug 7; 25, add new oil or other liquid lubricant and a clean-run or the old oil filter 5; and then 26, run the internal-combustion engine for two-to-ten minutes at varying speeds, replace the clean-run oil filter 5 with a new oil filter 5 and adjust the oil level.

Figure 11:
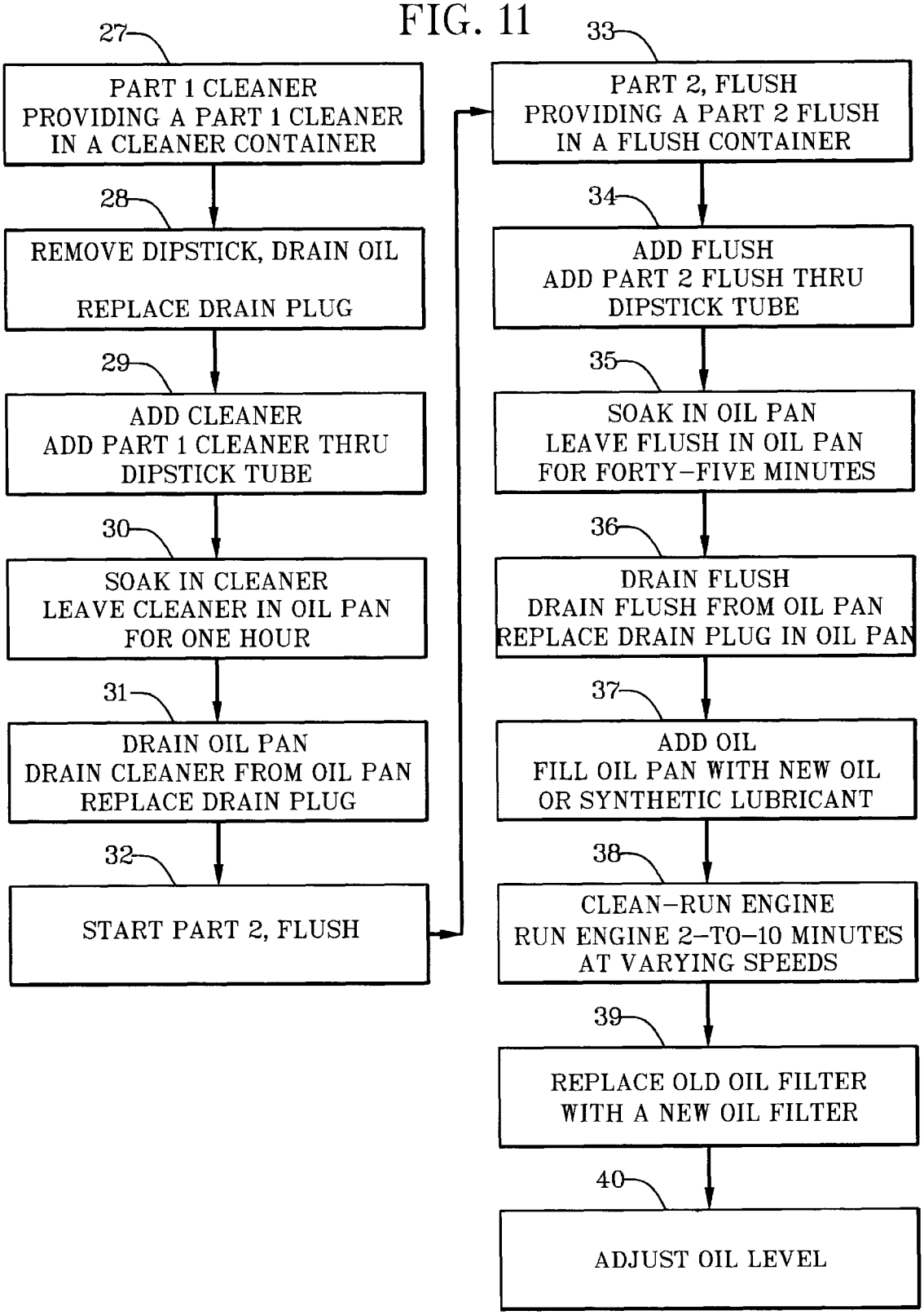
FIG. 11 is a diagram of a method for using this invention by putting the cleaner liquid and the flush liquid in through the dipstick tube.

Referring to FIG. 11 , steps included for this method with a specific cleaner container 8 and flush container 9 are to: 27, provide Part 1 cleaning liquid in a cleaner container 8; 28, remove dipstick, drain oil and replace the drain plug 7 in the drain aperture 15; 29, add cleaner liquid through the dipstick tube 10; 30, soak in cleaner liquid for one hour; 31, drain oil pan 3 and replace drain plug 7; 32, start Part 2 Flush; 33, provide Part 2 flush in flush container 9; 34, add flush liquid thru dipstick tube; 35, soak in oil pan 3 for about forty-five minutes; 36, drain oil pan 3; 37, fill oil pan 3 with new oil; 38, clean-run engine for about two-to-ten minutes at varying speeds; 39, replace oil filter 5; and 40 adjust oil level.

A new and useful oil-pump-screen cleaning method and apparatus having been described, all such foreseeable modifications, adaptations, substitutions of equivalents, mathematical possibilities of combinations of parts, pluralities of parts, applications and forms thereof as described by the following claims and not precluded by prior art are included in this intention.

What is claimed is:

1. A method comprising the following steps for in-place cleaning of an oil-pump pickup screen in an internal-combustion engine:

draining engine oil or other liquid lubricant from an oil pan of the internal-combustion engine;

putting an amount of a predeterminedly cleaning liquid into the oil pan for immersing the oil-pump pickup screen therein while preventing escape of the cleaning liquid from the oil pan and while preventing contact of the cleaning liquid with internal portions, parts and components of the internal-combustion engine, except for the oil-pump pickup screen, and portions of an inside periphery of the oil pan and an oil-pump pickup assembly which contain the cleaning liquid in contact with the oil-pump pickup screen;

allowing the cleaning liquid to remain in contact with the oil-pump pickup screen for a sufficient time for the cleaning liquid to disintegrate and to dislodge the hardened buildup of carbonic and other combustion-related engine-oil and fuel material from the oil-pump pickup screen;

draining the cleaning liquid and disintegrated and dislodged carbonic and other combustion-related engine-oil and fuel material from the oil pan;

putting an amount of a predetermined flush liquid into the oil pan for immersing the oil-pump pickup screen therein;

allowing the flush liquid to remain in contact with the oil-pump pickup screen for a sufficient time for the flush liquid to mix with any disintegrated and dislodged buildup of hardened carbonic and other combustion-related engine-oil and fuel material for fluid conveyance thereof from the oil-pump pickup screen and from the inside periphery of the oil pan;

draining the flush liquid and the disintegrated and dislodged carbonic and other combustion-related engine-oil and fuel material from the oil pan;

providing a clean-run oil filter in an oil-filter cannister for the internal-combustion engine;

preventing oil-pan escape of the engine oil or other liquid lubricant to be put into the oil pan thereafter for circulating the engine oil or other liquid lubricant for conveying residual disintegrated and dislodged carbonic and other combustion-related engine-oil and fuel material from the oil pan to the clean-run oil filter; and filling the oil-pan with the engine oil or other liquid lubricant.

2. The method of claim 1 further comprising the steps of:

running the engine a sufficient period of time at sufficient rotational speeds for the oil pump to circulate the engine oil or other liquid lubricant for conveying residual disintegrated and dislodged carbonic and other combustion-related engine-oil and fuel material from the oil pan to the clean-run oil filter; and replacing the clean-run oil filter with a new oil filter for running the engine thereafter with a prescribed amount of the engine oil or other liquid lubricant.

3. The method of claim 1 wherein:

the cleaning liquid includes a solvent capacity to damage bearings and gaskets of the internal-combustion engine in addition to including a carbon-disintegrative capacity to disintegrate and to dislodge the hardened buildup of carbonic and other combustion-related engine-oil and fuel material from the oil-pump pickup screen; and the flush liquid includes a flushing capacity to flush disintegrated and dislodged carbonic and other combustion-related engine-oil and fuel material in addition to being miscible with engine oil or other liquid engine lubricant.

4. The method of claim 2 wherein:

the cleaning liquid includes a solvent capacity to damage bearings and gaskets of the internal-combustion engine in addition to including a carbon-disintegrative capacity to disintegrate and to dislodge the hardened buildup of carbonic and other combustion-related engine-oil and fuel material from the oil-pump pickup screen; and the flush liquid includes a flushing capacity to flush disintegrated and dislodged carbonic and other combustion-related engine-oil and fuel material in addition to being miscible with engine oil or other liquid engine lubricant.

5. A method comprising the following steps for in-place cleaning of an oil-pump pickup screen in an internal-combustion engine;

providing a carbon-disintegrative liquid having a capacity to disintegrate and to dislodge hardened buildup of carbonic and other combustion-related engine-oil and fuel material from the oil-pump pickup screen;

providing a flush liquid having a capacity to flush any disintegrated and dislodged carbonic and other combustion-related engine-oil and fuel material from the oil-pump pickup screen;

the internal-combustion engine having a pickup screen proximate a top side of a bottom inside wall of an oil pan in which the oil-pump pickup screen is employed for screening engine oil or other liquid lubricant upstream fluidly from conveyance of the engine oil or other liquid lubricant to an oil pump of the internal-combustion engine;

draining the engine oil or other liquid lubricant from the oil pan;

preventing oil-pan escape of the carbon-disintegrative liquid to be put into the oil pan thereafter for the in-place cleaning;

putting an amount of the carbon-disintegrative liquid into the oil pan for immersing the oil-pump pickup screen therein while preventing contact of the carbon-disintegrative liquid with internal portions, parts and components of the internal-combustion engine, except for the oil-pump pickup screen, and portions of an inside periphery of the oil pan and an oil-pump pickup assembly which contain the carbon-disintegrative liquid in contact with the oil-pump pickup screen;

allowing the carbon-disintegrative liquid to remain in contact with the oil-pump pickup screen for a sufficient time for the carbon-disintegrative liquid to disintegrate and to dislodge the hardened buildup of carbonic and other combustion-related engine-oil and fuel material from the oil-pump pickup screen;

draining the carbon-disintegrative liquid and disintegrated and dislodged carbonic and other combustion-related engine-oil and fuel material from the oil pan;

preventing oil-pan escape of the flush liquid to be put into the oil pan thereafter for flushing the oil-pump pickup screen and the inside periphery of the oil pan which will have been in contact with the carbon-disintegrative liquid;

putting an amount of the flush liquid into the oil pan for immersing the oil-pump pickup screen therein;

allowing the flush liquid to remain in contact with the oil-pump pickup screen for a sufficient time for the flush liquid to mix with the hardened buildup of carbonic and other combustion-related engine-oil and fuel material for fluid conveyance thereof from the oil-pump pickup screen and from the inside periphery of the oil pan;

draining the flush liquid and the disintegrated and dislodged carbonic and other combustion-related engine-oil and fuel material from the oil pan;

providing a clean-run oil filter in an oil-filter cannister for the internal-combustion engine;

preventing oil-pan escape of the engine oil or other liquid lubricant to be put into the oil pan thereafter for circulating the engine oil or other liquid lubricant for conveying residual disintegrated and dislodged carbonic and other combustion-related engine-oil and fuel material from the oil pan to the clean-run oil filter;

filling the oil-pan with the engine oil or other liquid lubricant;

running the engine a sufficient period of time at sufficient rotational speeds for the oil pump to circulate the engine oil or other liquid lubricant for conveying residual disintegrated and dislodged carbonic and other combustion-related engine-oil and fuel material from the oil pan to the clean-run oil filter; and replacing the clean-run oil filter with a new oil filter for running the engine thereafter with a prescribed amount of the engine oil or other liquid lubricant.

6. The method of claim 5 wherein:

the carbon-disintegrative liquid is selected from a class of high-power solvents.

7. The method of claim 6 wherein:

the class of high-power solvents includes xylene.

8. The method of claim 6 wherein:

the class of high-power solvents includes toluene.

9. The method of claim 5 wherein:

the flush liquid is selected from a class of solvents that are miscible with hydrocarbon fuels.

10. The method of claim 9 wherein:

the class of solvents includes kerosene.

11. The method of claim 5 wherein:

the internal-combustion engine includes engine sizes for cars and trucks; and the amount of the carbon-disintegrative liquid is about forty-eight ounces.

12. The method of claim 5 wherein:

the internal-combustion engine includes engine sizes for cars and trucks; and the amount of the flush liquid is about forty-eight ounces.

13. The method of claim 5 wherein:

putting the carbon-disintegrative liquid into the oil pan while preventing contact of the carbon-disintegrative liquid with the internal portions, parts and components of the internal-combustion engine, except for the oil-pump pickup screen, and portions of the inside periphery of the oil pan and the oil-pump pickup assembly, includes conveying the carbon-disintegrative liquid through a dipstick tube of the internal-combustion engine.

14. The method of claim 5 wherein:

putting the carbon-disintegrative liquid into the oil pan while preventing contact of the carbon-disintegrative liquid with the internal portions, parts and components of the internal-combustion engine, except for the oil-pump pickup screen, and portions of the inside periphery of the oil pan and the oil-pump pickup assembly, includes conveying the carbon-disintegrative liquid through a drain-aperture plug having; and the drain-aperture plug being communicative fluidly with an inside periphery of a cleaner container for containing the carbon-disintegrative liquid.

15. The method of claim 5 wherein:

putting the flush liquid into the oil pan includes conveying the flush liquid through the dipstick tube of the internal-combustion engine.

16. The method of claim 5 wherein:

putting the flush liquid into the oil pan includes conveying the flush liquid through a drain-aperture plug; and the drain-aperture plug being communicative fluidly with an inside periphery of a flush container for containing the flush liquid.

17. A method comprising the following steps for in-place cleaning of an oil-pump pickup screen in an internal-combustion engine;

providing a carbon-disintegrative liquid having a capacity to disintegrate and to dislodge hardened buildup of carbonic and other combustion-related engine-oil and fuel material from the oil-pump pickup screen;

providing a flush liquid having a capacity to flush disintegrated and dislodged the carbonic and other combustion-related engine-oil and fuel material from the oil-pump pickup screen;

the internal-combustion engine having a pickup screen proximate a top side of a bottom inside wall of an oil pan in which the oil-pump pickup screen is employed for screening engine oil or other liquid lubricant upstream fluidly from conveyance of the engine oil or other liquid lubricant to an oil pump of the internal-combustion engine;

draining the engine oil or other liquid lubricant from the oil pan;

soaking the oil-pump pickup screen in the carbon-disintegrative liquid for a sufficient period of time for disintegrating and dislodging the hardened buildup of carbonic and other combustion-related engine-oil and fuel material from the oil-pump pickup screen;

removing the carbon-disintegrative liquid from the oil-pump pickup screen;

soaking the oil-pump pickup screen in the flush liquid;

removing the flush liquid;

refilling the oil pan with the engine oil or other liquid lubricant;

circulating the engine oil or other liquid lubricant through a clean-run oil filter by running the internal-combustion engine for about two-to-ten minutes; and replacing the clean-run oil filter with a new oil filter.

18. A method comprising the following steps for in-place cleaning of an oil-pump pickup screen in an internal-combustion engine;

providing a carbon-disintegrative liquid having a capacity to disintegrate and to dislodge hardened buildup of carbonic and other combustion-related engine-oil and fuel material from the oil-pump pickup screen;

providing a flush liquid having a capacity to flush disintegrated and dislodged carbonic and other combustion-related engine-oil and fuel material from the oil-pump pickup screen;

the internal-combustion engine having a pickup screen proximate a top side of a bottom inside wall of an oil pan in which the oil-pump pickup screen is employed for screening engine oil or other liquid lubricant upstream fluidly from conveyance of the engine oil or other liquid lubricant to an oil pump of the internal-combustion engine;

putting a single-use amount of the carbon-disintegrative liquid in a cleaner container having a fluid-containment size for containing an amount of the carbon-disintegrative liquid to immerse the oil-pump pickup screen in the carbon-disintegrative liquid within the oil pan;

the cleaner container including a fluid conveyance that is communicative fluidly with an engine aperture having fluid communication to the oil-pump pickup screen directly without fluid contact with internal portions, parts and components of the internal-combustion engine en route to the oil-pump pickup screen;

putting a single-use amount of the flush liquid in a flush container having a fluid-containment size for containing an amount of the flush liquid to immerse the oil-pump pickup screen in the flush liquid within the oil pan;

the flush container including a fluid conveyance that is communicative fluidly with the engine aperture having fluid communication to the oil-pump pickup screen directly without fluid contact with internal portions, parts and components of the internal-combustion engine en route to the oil-pump pickup screen;

draining the engine oil or other liquid lubricant from the oil pan by removal of a drain plug from a drain aperture in the oil pan;

replacing the drain plug in the drain aperture;

conveying the carbon-disintegrative liquid from the cleaner container to the oil pan through the engine aperture having fluid communication to the oil-pump pickup screen directly;

soaking the oil-pump pickup screen in the carbon-disintegrative liquid for a predetermined period of time in the oil pan;

draining the carbon-disintegrative liquid from the oil pan by removal of the drain plug from the drain aperture;

replacing the drain plug in the drain aperture;

conveying the flush liquid from the flush container to the oil pan through the engine aperture having fluid communication to the oil-pump pickup screen directly;

soaking the oil-pump pickup screen in the flush liquid for a predetermined period of time in the oil pan;

draining the flush liquid from the oil pan by removal of the drain plug from the drain aperture;

replacing the drain plug in the drain aperture;

filling the oil pan predeterminedly with engine oil or other liquid lubricant;

running the internal-combustion engine at varying speeds for about two-to-ten minutes for circulating the engine oil or other liquid lubricant through a clean-run oil filter in an oil-filter cannister of the internal-combustion engine; and replacing the clean-run oil filter with a new oil filter.

19. The method of claim 18 wherein:

the carbon-disintegrative liquid is selected from a class of isomeric aromatic hydrocarbons $C_8H_{10}$ that are di-methyl homologues of benzine.

20. The method of claim 18 wherein:

the carbon-disintegrative liquid includes xylene.

21. The method of claim 18 wherein:

the carbon-disintegrative liquid includes toluene.

22. The method of claim 18 wherein:

the period of time for soaking the oil-pump pickup screen in the carbon-disintegrative liquid is about one hour.

23. The method of claim 18 wherein:

the period of time for soaking the oil-pump pickup screen in the flush liquid is about forty-five minutes.

24. The method of claim 18 wherein:

the engine aperture having fluid communication to the oil-pump pickup screen directly without fluid contact with internal portions, parts and components of the internal-combustion engine en route to the oil-pump pickup screen includes a dipstick tube; and the fluid conveyance of the cleaner container that is communicative fluidly with the engine aperture includes a container cap having a tubular extension that can be inserted into the dipstick tube.

25. The method of claim 22 wherein:

the fluid conveyance of the flush container that is communicative fluidly with the engine aperture includes a container cap having a tubular extension that can be inserted into the dipstick tube.

26. The method of claim 18 wherein:

the cleaner container includes cleaning directions for use of the carbon-disintegrative liquid.

27. The method of claim 24 wherein:

the cleaning directions include instructions to: (a) insert the carbon-disintegrative liquid through the dipstick tube after draining the oil from the oil pan and replacing the drain plug in the drain aperture; (b) leave the carbon-disintegrative liquid in the oil pan for one hour; (c) drain the carbon-disintegrative liquid from the oil pan; (d) replace the drain plug in the drain aperture; and then to (e) flush the oil pan as directed on the flush container.

28. The method of claim 18 wherein:

the flush container includes flushing directions for use of the flush liquid.

29. The method of claim 28 wherein:

the flushing directions include instructions to: (a) insert the flush liquid through the dipstick tube after draining the carbon-disintegrative liquid from the oil pan and replacing the drain plug in the drain aperture; (b) leave the flush liquid in the oil pan for about forty-five minutes; (c) drain the flush liquid from the oil pan; (d) replace the drain plug in the drain aperture; (e) fill the oil pan with new engine oil or other liquid lubricant; (f) run the internal-combustion engine for about two-to-ten minutes at varying speeds while a clean-run oil filter, which can be a used oil filter, is in the oil-filter cannister; (g) replace the clean-run oil filter with a new oil filter; and then (h) assure that a proper amount of engine oil or other liquid lubricant is in the oil pan for running the internal-combustion engine selectively thereafter.

* * * * *